US005515789A

United States Patent [19]

Brochand et al.

[11] Patent Number: 5,515,789

[45] Date of Patent: May 14, 1996

[54] GRIP GUIDING DEVICE FOR AERIAL CABLEWAYS

[75] Inventors: Max Brochand, Noyarey; Jean-Pierre Rastello, Grenoble, both of France

[73] Assignee: Pomagalski S.A., France

[21] Appl. No.: 283,947

[22] Filed: Aug. 1, 1994

[30] Foreign Application Priority Data

Aug. 25, 1993 [FR] France ..... 93 10374

[51] Int. Cl.[6] ..... B61B 12/00

[52] U.S. Cl. ..... 104/184; 104/173.1; 104/87; 104/178; 104/197; 104/233; 104/234

[58] Field of Search ..... 104/173.1, 174, 104/184, 173.2, 202, 178, 28, 87, 179, 188, 197, 189, 233, 234

[56] References Cited

U.S. PATENT DOCUMENTS 4,641,585 2/1987 Tarassoff ..... 104/173.2

5,121,695 6/1992 Feuz ..... 104/178

FOREIGN PATENT DOCUMENTS 0218306 4/1987 European Pat. Off. .

0218897 4/1987 European Pat. Off. .

3295750 12/1991 Japan ..... 104/184

*Primary Examiner*—Mark T. Le

*Attorney, Agent, or Firm*—Parkhurst, Wendel & Rossi

[57] ABSTRACT

A single-cable aerial cableway including guide rails forming a lead-in guide, secured to a stationary cable support structure. The lead-in guide cooperates with a wheel secured to the grip so as to stabilize and position the grip and the load before they pass along the structure. The position of the lead-in guide is automatically adjusted when the position in height of the cable changes so that the weel always enter the lead-in guide.

8 Claims, 3 Drawing Sheets

GRIP GUIDING DEVICE FOR AERIAL CABLEWAYS

BACKGROUND OF THE INVENTION

The invention relates to an aerial cableway comprising, a continuously moving endless cable connecting two stations, carriages and loads having hanger arms for securing the loads to said carriages, a grip for each of said carriages, for coupling the carriage to the cable, a stationary cable supporting structure having cable supporting sheaves rotatably mounted to the structure and a grip guiding device secured to the stationary structure and being formed to stabilize and to position the grip for passage of the grip and hanger arm over the cable supporting sheaves and for passengers embarking and disembarking.

The invention is described hereafter as being applied to a detachable chairlift having a grip guiding device at the station entrance but it is clear that it can be applied to other types of cable transport installations, such as gondola lifts or fixed grip chairlifts, as well as to grip guiding devices provided on cable support towers.

The chair is connected with the grip carriage by means of a hanger arm and the hanger arm and carriage should freely passe over the cable support structure at all possible angles of swing of the chair, for instance due to the action of the wind or to an irregular loading of the chair. It has already been proposed to limit the swing of the chair, when the chair comes nearby a stationary cable support structure, by means of a lead-in guide secured to this support structure so as to guide and to place the grip carriage in a balanced position to facilitate the passage on the support structure as well as the embarking and disembarking of the passengers. The enlarged entrance portion of the lead-in guide receives a wheel provided on the grip carriage and this entrance portion must be large enough to receive this wheel at all possible angles of swing and positions of the chair and positions of the cable.

When the chair travel speed and/or the chair swing angles are high, the guiding forces generated by the conventional lead-in guide increase excessively and provoke dangerous oscillations and bumps. These forces may be reduced by increasing the length of the lead-in guide, so as to reduce the slope of the guide rails, constituting the lead-in guide, but such an arrangement complicates the overall layout of the station or that of the support towers.

SUMMARY OF THE INVENTION

The object of the present invention is to achieve a grip guiding device with a simple structure allowing high chair travel speeds. The present invention is characterized in that the grip guiding device comprises a guide rail which extends in a vertical plane parallel to the cable and has one extremity portion pivotally mounted on the structure so as to be able to pivot in the vertical plane, and an other extremity portion spaced from said structure and moving in a direction towards or away from the cable when the guide rail pivots, and that a guide rail pivoting device is controlled by a detector of the position of the cable so as to position the guide rail to cooperate with and to gradually guide the grip towards the position for passage over the cable supporting sheaves.

The grip guiding device comprises advantageously two guide rails forming a convergent lead-in guide to gradually guide the grip towards the position for passage over the cable supporting sheaves.

In accordance with the present invention the position of the lead-in guide is automatically adjusted when the load on the cable and thus when the position in height of the cable changes. The entrance of the lead-in guide and the slope of the guide rail may accordingly be reduced.

The carriage comprises a wheel which cooperates with the guide rail for stabilization of the chair. The cableway may be of the single cable type, having detachable grips and a transfer rail in the station on which the carriages, detached from the cable, run. The transfer rail has an entrance extremity and the guide rail is pivotally mounted on said entrance extremity so as to extend the transfer rail upstream with respect to the carriage movement. At the entrance to the station the wheel of the carriage enters the lead-in guide while the grip is still coupled to the cable. The lead-in guide guides the wheel towards the transfer rail and stabilizes the grip, which is uncoupled from the cable when the wheel runs on the transfer rail.

The detector of the position of the cable comprises advantageously two rollers surrounding the cable and this detector is mechanically linked to the grip guiding device so as to position the guiding device in accordance with the position in height of the cable. The cable position may be detected by optical or electrical means which control the guiding device position in any suitable manner.

Other objects and advantages of the invention will appear from a description of a preferred form thereof.

DESCRIPTION OF THE PREFERRED EMBODIMENT

Figure 1:
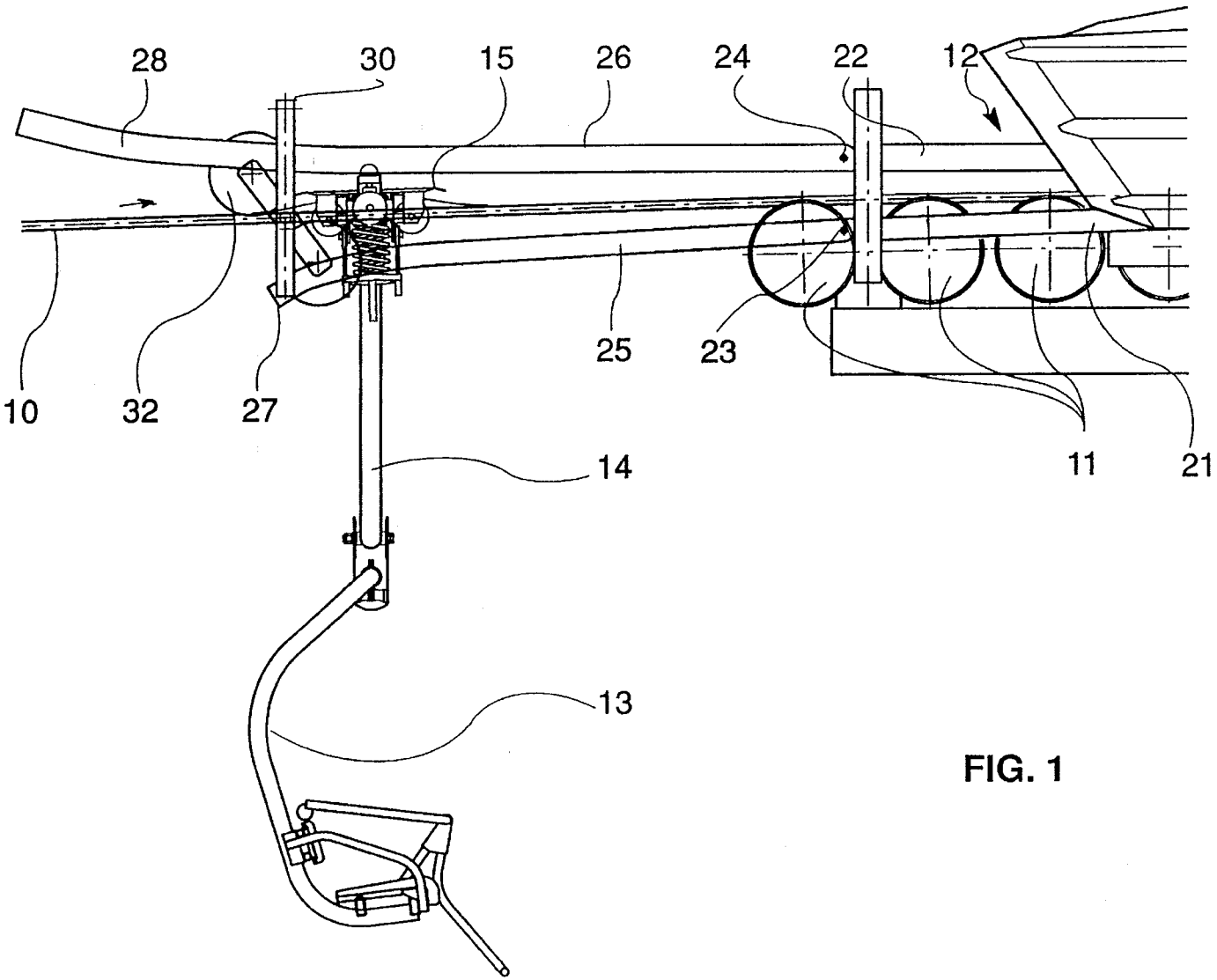
FIG. 1 is a schematic elevation view of a grip guiding device according to the invention.

In the figures, an overhead continuous moving cable 10 of a single cable chairlift extends between two stations and runs in each station on support sheaves 11, secured to a stationary structure 12. Chairs 13, each holding four or six passengers, for example, are fixed by a hanger arm 14 to a carriage comprising a grip 15 coupling it to the cable 10. The illustrated installation is a detachable chairlift having detachable grips 15 for uncoupling the chairs 13 from the cable 10 at the entrance to the station and for coupling them at the exit in a well known manner, to allow passengers embarking and disembarking at low speed. The invention may be applied to fixed grip chairlifts and to other similar cableways, such as gondola-lifts. The grip 15 has jaws 16 and a spring 17 which urges the grip 15 in the cable clamping position, opening being controlled by a lever 18 cooperating with a fixed ramp (not shown). The grip 15 carriage has wheels 19,20, which in the station run on transfer rails supporting the grip uncoupled from the cable 10. In the shown embodiment, a wheel 19, near the cable 10, runs on a rail (not shown) and another wheel 20, spaced from the cable 10, is surrounded by a pair of transfer rails, a lower rail 21 and an upper rail 22, which guide and position in height wheel 20. The dimension of wheel 20 corresponds substantially to the space between the transfer rails 21,22, which are disposed at the entrance to the station so that the wheel 20 engages on these rails 21,22, as soon as the grip 15 passes on the first cable supporting sheave 11. On the entrance extremity 23 of the lower transfer rail 21 is rotatably mounted an extremity of a lower guide rail 25, which extends the transfer rail 21 in the cable direction, upstream with respect to the cable movement. In the same way an extremity of an upper guide rail 26 is rotatably mounted on the entrance extremity 24 of the upper transfer rail 22, so as to extend this rail 22 forward, in the zone before the first cable support sheave 11. The free extremities 27,28 of the guide rails 25,26, opposite to the extremities rotatably mounted on the transfer rails 21,22, are spaced so as to constitute an enlarged entry portion of a lead-in guide, which gets narrower up to the spacing dimension of the corresponding transfer rails 21,22. The free extremities 27,28 are rigidly secured to a leg 29 of an inverted U shaped bracket 30 which overlaps the grip 15. The opposite leg 31 of the bracket 30 supports two rollers 32 surrounding the cable 10, one roller 32 running on the upper cable face and the other roller 32 on the lower cable face. The two rollers 32 are slightly shifted in the cable direction so as to facilitate the passage of the grip 15. It is easy to see that any upward or downward movement of cable 10 is transmitted by the rollers 32 and the bracket 30 to the guide rails 25,28, so that the correct position of the enlarged entry portion of the lead-in guide with respect to the position in height of the cable 10 is maintained. The opening of this entry portion may thus accordingly be reduced.

Figure 2:
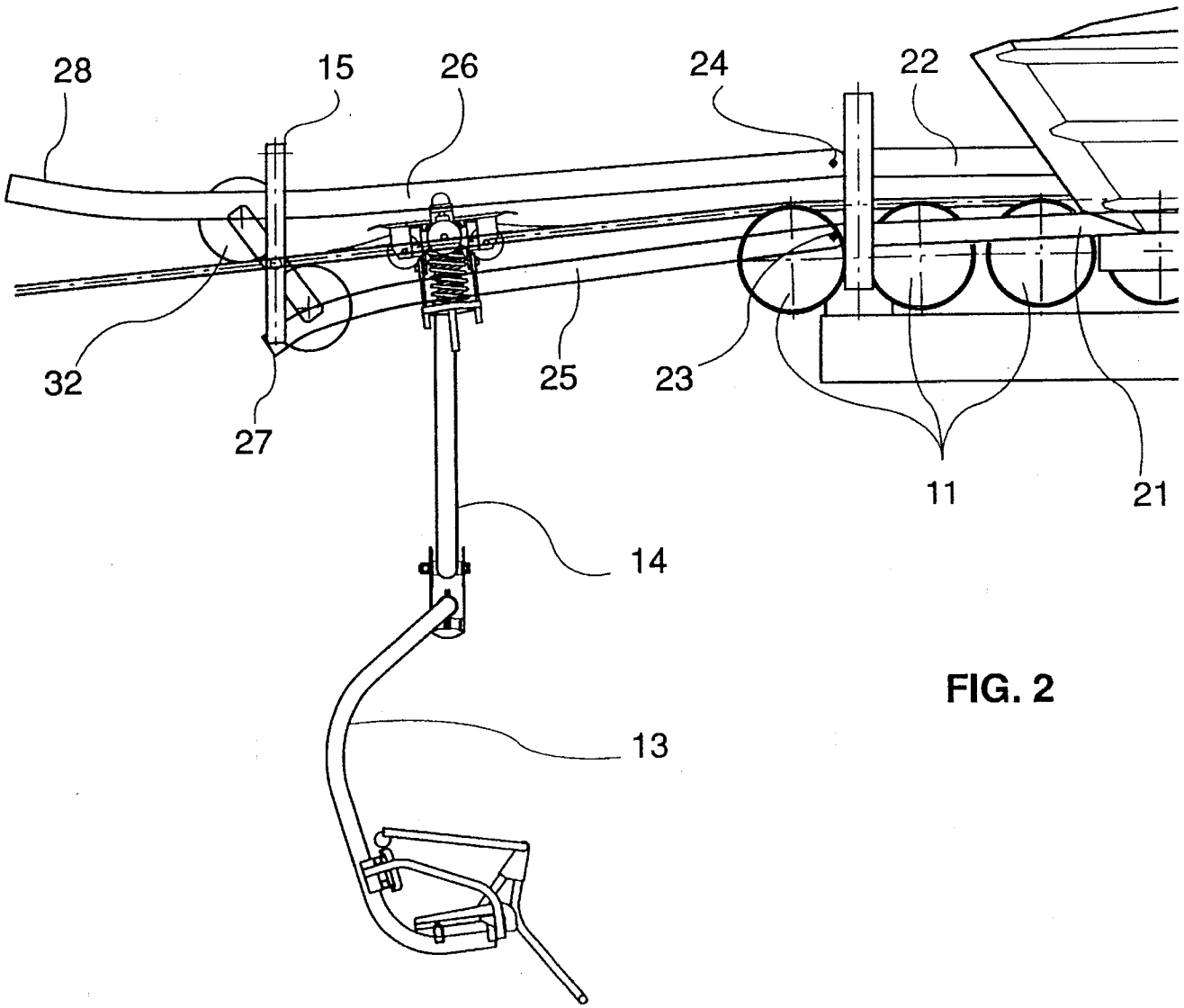
FIG. 2 is a similar view to that of FIG. 1, showing the grip guiding device in an other operating position than in FIG. 1;.
Figure 3:
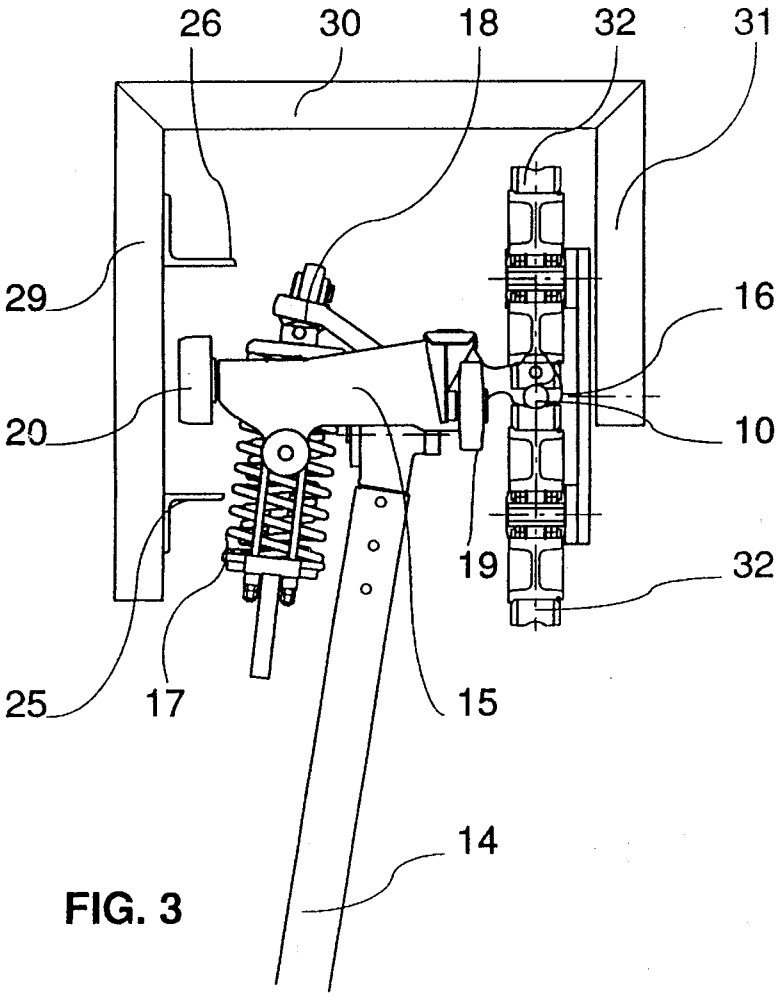
FIG. 3 is a side view of the grip guiding device of FIG. 1, showing the grip in a stabilized correct position.

The grip guiding device described hereinbefore operates as follows. When the grip 15 is in the correct position, shown in FIG. 3, for passage over the cable supporting sheaves 11 at the entrance of the station or of a cable support tower, the wheel 20 does not engage and cooperate with the guide rails 25,26, It can be seen that in the upper position of cable 10, shown in FIG. 1 and in the lower cable position, shown in FIG. 2, when the cableway is more loaded, the position of the lead-in guide entry portion with respect to the cable position remains the same, because a downward or upward shift of the cable 10 is detected by the rollers 32 and transmitted by the bracket 30 to the free extremities 27,28 of the guide rails 25,26, which pivot downwards or upwards. The guide rails 25,26 position is automatically adjusted.

Figure 4:
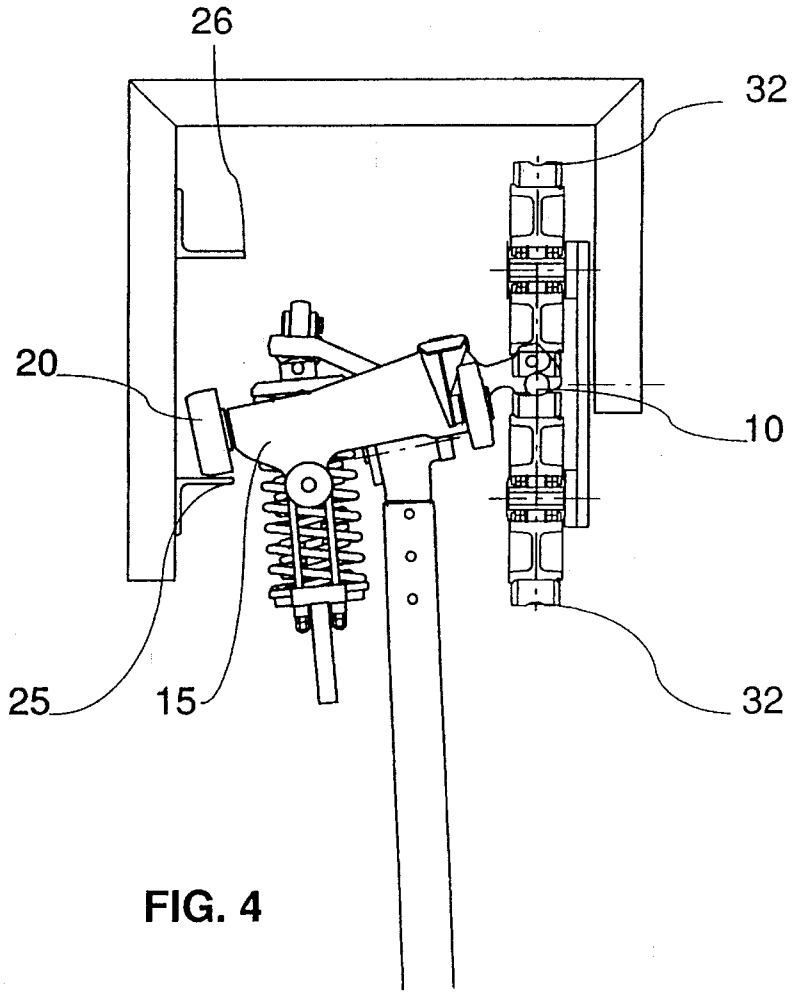
FIG. 4 is a similar view to that of FIG. 3, showing the grip in an offset position.

The operation of the guide rails 25,26 can be seen from FIG. 4. The chair 13 is irregular loaded and the wheel 20 engages the lower guide rail 25. During the grip travel along the guide rail 25 the wheel 20 is shifted upward to stabilize and position the grip 15 before its passage on the support sheaves 11. It is clear that the wheel 20 engages the upper guide rail 26 when the chair swings in the opposite direction and that only one guide rail 25,26 is needed if the chair 13 always swings in the same direction. Further one or both of the guide rails 25,26 may be independent from the transfer rails 22,23 and cooperate with another element or with other elements of the carriage or the chair.

We claim:

1. An aerial cableway, comprising:

an endless overhead cable extending between two stations;

a plurality of carriages each having a load secured thereto via a hanger arm, and a grip for coupling each respective carriage to the cable;

a fixed supporting structure having rotatable sheaves;

a grip guiding device for guiding each grip to pass over the rotatable sheaves, said grip guiding device comprising at least one guide rail pivotally secured to the supporting structure and extending substantially parallel to the cable, said at least one guide rail being pivotal in a vertical plane;

positioning means for maintaining a fixed vertical position of said at least one guide rail with respect to the cable by pivoting said at least one guide rail in accordance with vertical movements of the cable.

2. The aerial cableway of claim 1, wherein each carriage further includes at least one wheel which is receivable by said at least one guide rail.

3. The aerial cableway of claim 2, wherein said at least one wheel is provided in said vertical plane.

4. The aerial cableway of claim 1, wherein said at least one guide rail comprises two guide rails which are spaced apart from each other in said vertical plane.

5. The aerial cableway of claim 4, wherein said two guide rails diverge from each other along a direction extending from the supporting structure.

6. The aerial cableway of claim 1, wherein said positioning means comprises two opposed rollers secured to the grip guiding device, wherein the cable passes between the two opposed rollers.

7. The aerial cableway of claim 1, wherein said supporting structure includes at least one transfer rail extending from said at least one guide rail.

8. The aerial cableway of claim 1, wherein:

said at least one guide rail comprises two guide rails which are spaced apart from each other in said vertical plane, said two guide rails diverge from each other along a direction extending from the supporting structure, each carriage further includes at least one wheel which is receivable by said two guide rails, said supporting structure includes at least one transfer rail extending from the two guide rails, and said at least one wheel of each carriage runs along said at least one transfer rail to support each respective carriage.

* * * * *